US010672359B2

(12) United States Patent
Tomie

(10) Patent No.: US 10,672,359 B2
(45) Date of Patent: Jun. 2, 2020

(54) DISPLAY DRIVER, ELECTRO-OPTICAL DEVICE, AND ELECTRONIC APPARATUS

(71) Applicant: SEIKO EPSON CORPORATION, Tokyo (JP)

(72) Inventor: Akihiro Tomie, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/356,145

(22) Filed: Mar. 18, 2019

(65) Prior Publication Data

US 2019/0287477 A1 Sep. 19, 2019

(30) Foreign Application Priority Data

Mar. 19, 2018 (JP) ..... 2018-050396

(51) Int. Cl.
*G09G 3/36* (2006.01)

(52) U.S. Cl.
CPC ..... *G09G 3/3688* (2013.01); *G09G 2310/027* (2013.01); *G09G 2310/0286* (2013.01); *G09G 2310/0297* (2013.01); *G09G 2310/08* (2013.01); *G09G 2330/021* (2013.01)

(58) Field of Classification Search
CPC ..... G09G 2310/027; G09G 2310/0286; G09G 2310/0297; G09G 2310/08; G09G 2330/021; G09G 3/3688
See application file for complete search history.

(56) References Cited

U.S. PATENT DOCUMENTS

2006/0092485 A1* 5/2006 Tamaru ..... H04N 9/045 358/518
2007/0040822 A1* 2/2007 Koyama ..... G09G 3/2022 345/204

FOREIGN PATENT DOCUMENTS

JP 2007-086752 A 4/2007
JP 2008-065295 A 3/2008
JP 2010-091825 A 4/2010
JP 2015-114399 A 6/2015

* cited by examiner

*Primary Examiner* — Insa Sadio
(74) *Attorney, Agent, or Firm* — Oliff PLC

(57) ABSTRACT

A display driver includes amplifier circuits, D/A conversion circuits configured to output D/A conversion voltages to the amplifier circuits, a logic circuit, and signal line groups that couple the D/A conversion circuits to the logic circuit. The amplifier circuits are disposed in a direction D1. The D/A conversion circuits are disposed in the direction D1 on a direction D2 of the amplifier circuits. The logic circuit is disposed on the direction D2 of the D/A conversion circuits, and outputs first to n-th display data, with each display data being k bits, to the D/A conversion circuit on the signal line group in a time division manner.

12 Claims, 11 Drawing Sheets

DISPLAY DRIVER, ELECTRO-OPTICAL DEVICE, AND ELECTRONIC APPARATUS

BACKGROUND

1. Technical Field

The present invention relates to a display driver, an electro-optical device, and an electronic apparatus.

2. Related Art

In an electro-optical device such as a liquid crystal display device, a display driver drives an electro-optical panel to write data voltage to a pixel. The electro-optical panel is provided with a plurality of image signal input terminals along a long side of the electro-optical panel. For example, when a 4K panel having 3840 pixels in a horizontal direction is driven by demultiplexing driving with a multiplex count of 8, 480 image signal input terminals are provided along the long side. To supply image signals to these image signal input terminals, a display driver integrated circuit (IC) has a slender, rectangular shape, and is mounted on a substrate so that the long side faces the long side of the electro-optical panel. For example, the display driver IC is mounted on a flexible substrate coupled to the electro-optical panel.

When an electro-optical panel having a large number of terminals, such as a 4K panel, is driven, the electro-optical panel is driven using a plurality of display drivers. When two display drivers are used, for example, two flexible substrates are stacked and coupled to the electro-optical panel, and one display driver IC is mounted on each of the flexible substrates. This makes it possible to drive an electro-optical panel having twice as many inputs as image signal output terminals of the display driver. For example, JP-A-2010-91825 discloses a technique for driving an electro-optical panel using a plurality of display drivers.

The display driver includes a gate array circuit, a line latching circuit, a multiplexer, a digital-to-analog (D/A) conversion circuit, and an amplifier circuit. The gate array circuit outputs display data corresponding to one multiplexer in one data output, and repeats this in a time division manner to output one line of display data to the line latching circuit. For example, when the display data of one pixel is 12 bits and demultiplexing driving with a multiplex count of 8 is performed, one data output becomes 96 bits. Ninety-six signal lines for transmitting 96 bits are wired in a long-side direction of the line latching circuit, that is, in a long-side direction of the display driver IC. Ninety-six signal lines are then wired around from the left and right of the gate array circuit and coupled to the 96 signal lines thus wired in this long-side direction.

According to the configuration described above, the line latching circuit is disposed in a layout separate from that of the gate array circuit, and thus a large number of signal lines are wired around from the left and right of the gate array circuit and coupled to the line latching circuit. This layout region of the wiring thus routed around is one of the factors behind an increase in the length of the long side of the display driver IC.

SUMMARY

According to an aspect of the invention, a display driver includes first to m-th amplifier circuits configured to drive an electro-optical panel, the m being an integer greater than or equal to 2, first to m-th digital-to-analog conversion circuits configured to output first to m-th D/A conversion voltages to the first to m-th amplifier circuits, a logic circuit, and first to m-th signal line groups configured to couple the first to m-th D/A conversion circuits to the logic circuit. The first to m-th amplifier circuits are disposed in a first direction. The first to m-th D/A conversion circuits are disposed in the first direction on a second direction side of the first to m-th amplifier circuits, with the second direction being orthogonal to the first direction. The logic circuit is disposed on the second direction side of the first to m-th D/A conversion circuits, and configured to output first to n-th display data with each display data being k bits, in a time division manner to an i-th D/A conversion circuit of the first to m-th D/A conversion circuits via an i-th signal line group of the first to m-th signal line groups, the n and k being integers greater than or equal to 2 and i being an integer from 1 to m, inclusive.

According to another aspect of the invention, the logic circuit may be configured to latch the first to n-th display data, and output the latched first to n-th display data in a time division manner.

According to a further aspect of the invention, the logic circuit may be a gate array circuit automatically arranged and wired, or a standard cell array circuit automatically arranged.

According to a still further aspect of the invention, the logic circuit may be configured to divide the first to n-th display data into high order side bit data and low order side bit data, respectively, and output the high order side bit data and the low order side bit data in a time division manner.

According to a still further aspect of the invention, the logic circuit may be configured to perform an overdrive arithmetic based on j-th display data of the first to n-th display data, and output overdrive display data obtained by the overdrive arithmetic, and the j-th display data in a time division manner, the j being an integer from 1 to n, inclusive.

According to a still further aspect of the invention, the logic circuit may be configured to divide the overdrive display data and the j-th display data into high order side bit data and low order side bit data, respectively, and output the high order side bit data and the low order side bit data of the overdrive display data, and the low order side bit data of the j-th display data in a time division manner.

According to a still further aspect of the invention, the logic circuit may be configured to output a control signal of the i-th D/A conversion circuit to the i-th D/A conversion circuit via the i-th signal line group, and the i-th signal line group may include a signal line configured to transmit the first to n-th display data, and a signal line configured to transmit the control signal.

According to a still further aspect of the invention, the i-th D/A conversion circuit may include an arithmetic circuit configured to perform arithmetic processing based on the first to n-th display data, and the control signal may be a signal configured to control the arithmetic circuit.

According to a still further aspect of the invention, the i-th D/A conversion circuit may include a latching circuit configured to latch display data from the logic circuit, the control signal may be a latch signal of the latching circuit, and the logic circuit may be configured to output the p-th display data of the first to n-th display data and the latch signal configured to latch the p-th display data, and not to output the latch signal configured to latch q-th display data when the q-th display data following the p-th display data is the same as the p-th display data, the p being an integer from 1 to n, inclusive, and the q being an integer from 1 to n, inclusive, and $q \neq p$.

According to a still further aspect of the invention, each of the signal lines of the i-th signal line group may be wired in the second direction.

Another aspect of the invention is related to an electro-optical device including the display driver described in any of the descriptions above, and the electro-optical panel.

Further, still another aspect of the disclosure is related to an electronic apparatus including the display driver described in any of the descriptions above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described in detail hereinafter. Note that the exemplary embodiments described hereinafter are not intended to limit the content of the disclosure as set forth in the claims, and not all of the configurations described in the exemplary embodiments are absolutely required to address the issues described in the disclosure.

1. Display Driver

Figure 1:
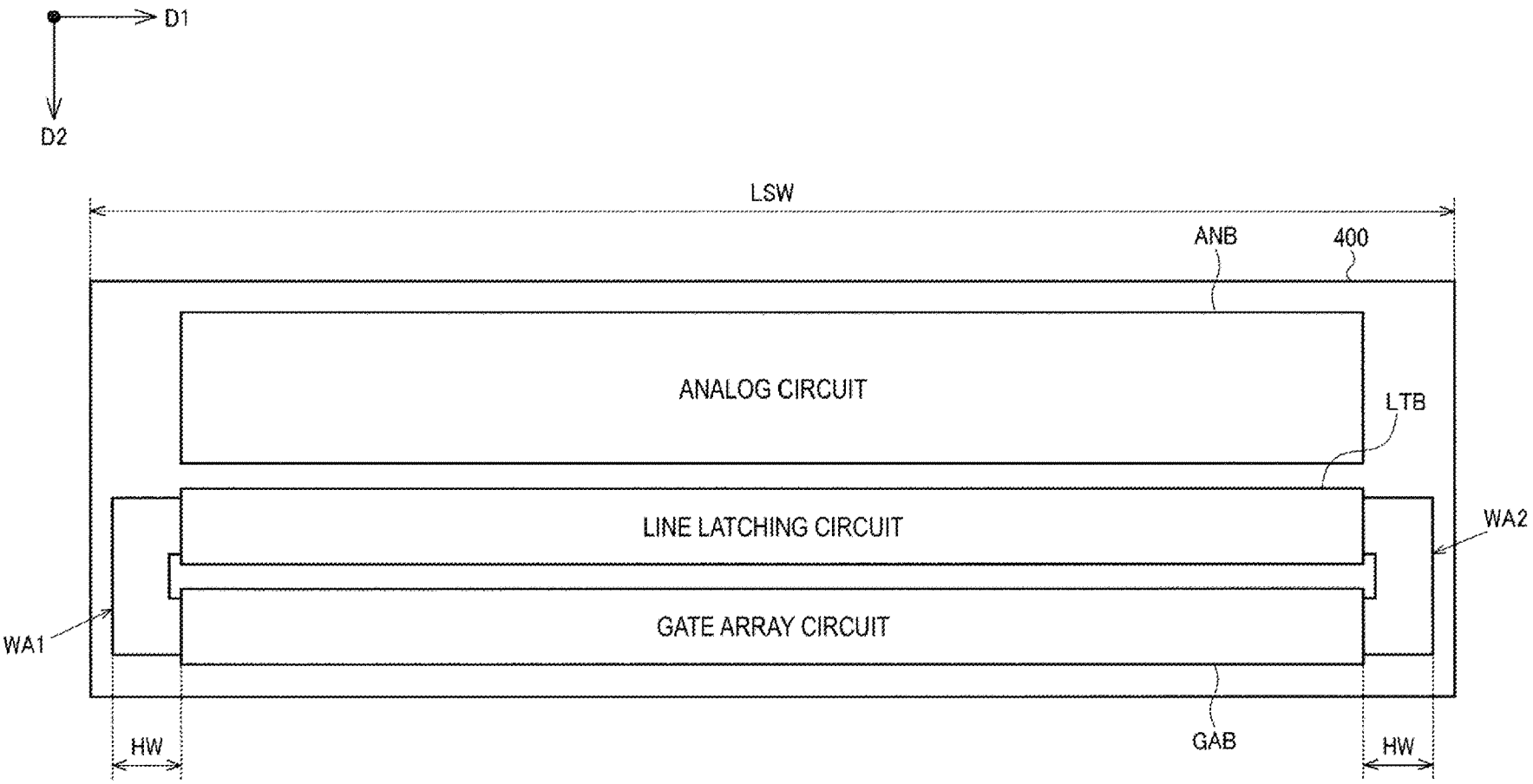
FIG. 1 is an example of a layout configuration of a display driver when a line latching circuit is provided outside a gate array circuit.
Figure 2:
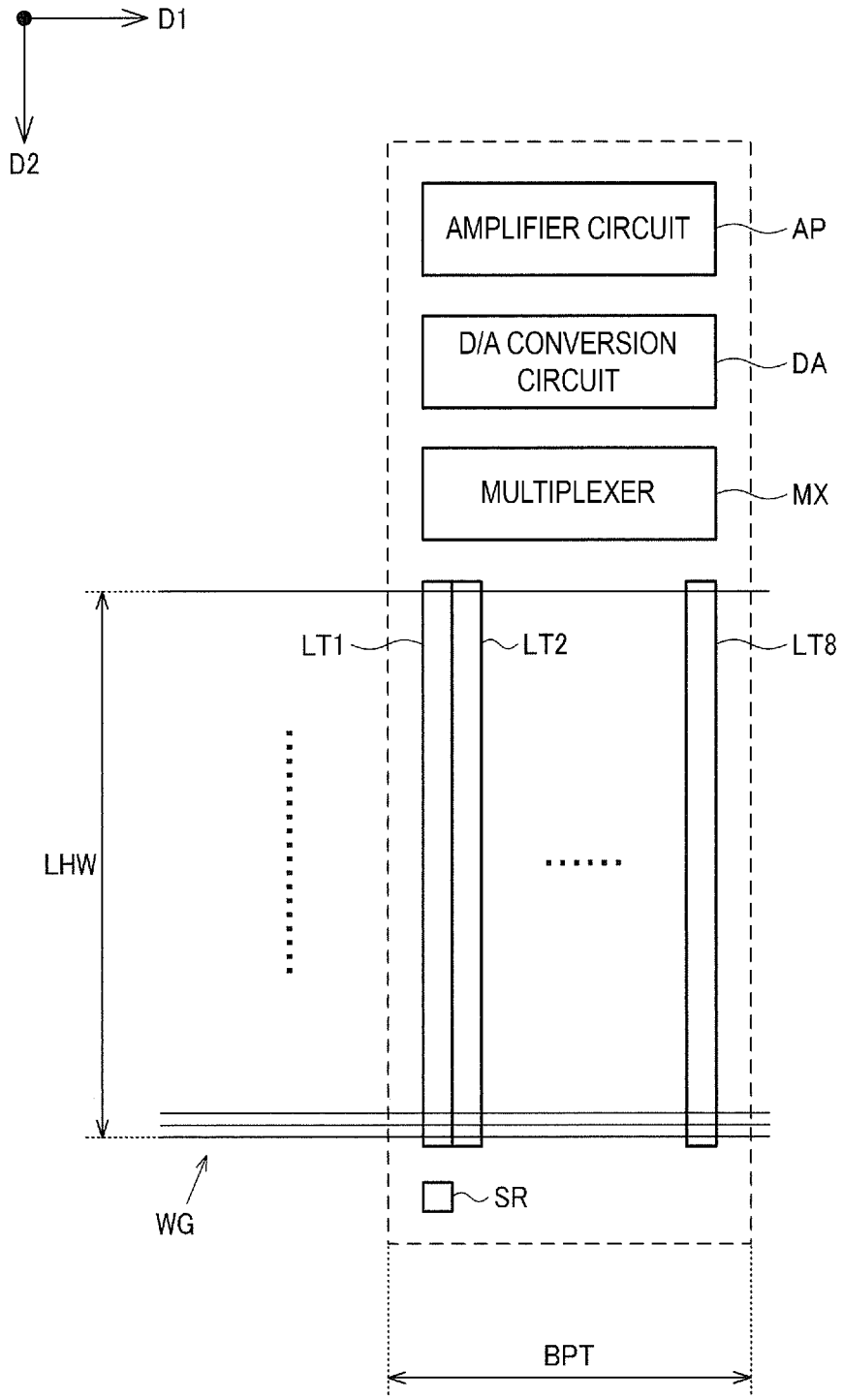
FIG. 2 is an example of a layout configuration of the display driver when the line latching circuit is provided outside the gate array circuit.

FIG. 1 and FIG. 2 are examples of a layout configuration of a display driver 400 when a line latching circuit is provided outside a gate array circuit. FIG. 1 and FIG. 2 illustrate the layout arrangement in which a semiconductor chip is viewed from a thickness direction.

As illustrated in FIG. 1, the semiconductor chip of the display driver 400 has a rectangular shape. A long-side direction of the semiconductor chip is denoted as D1, and a short-side direction of the semiconductor chip is denoted as D2. The display driver 400 includes an analog circuit ANB, a line latching circuit LTB disposed in the direction D2 (second direction) of the analog circuit ANB, and a gate array circuit GAB disposed on the direction D2 side of the line latching circuit LTB.

The long sides of the analog circuit ANB, the line latching circuit LTB, and the gate array circuit GAB are the sides in the direction D1, and the lengths of these long sides are substantially identical. In the following, a length in the direction D1 is referred to as a lateral width. The gate array circuit GAB and the line latching circuit LTB are coupled by signal lines wired in wiring regions WA1 and WA2. These signal lines are each wired to be routed around from the short side of the gate array circuit GAB to the short side of the line latching circuit LTB. As a result, given HW as the lateral widths of the wiring regions WA1 and WA2, a lateral width LSW of the display driver 400 is 2×HW longer than the lateral width of the gate array circuit GAB and the like.

FIG. 2 is an example of a layout configuration of a circuit block provided correspondingly to one output. Here, "one output" refers to the output of an image signal to one image signal output terminal. While only one block is illustrated in FIG. 2, in actuality a quantity of circuit blocks equivalent to the number of outputs are aligned in the direction D1. Note that, in the description below, a case where the multiplex count in demultiplexing driving is 8 is used as an example.

An amplifier circuit AP and a D/A conversion circuit DA are included in the analog circuit ANB in FIG. 1, and a multiplexer MX, latching circuits LT1 to LT8, and a shift register SR are included in the line latching circuit LTB in FIG. 1. The number of gate array circuits GAB is one for all outputs. Each of the latching circuits LT1 to LT8 retain the display data of one pixel. When the display data of one pixel is 12 bits, for example, the latching circuits LT1 to LT8 retain 96 bits of data. A signal line group WG including 96 signal lines is wired in the direction D1 above the latching circuits LT1 to LT8. This signal line group WG is coupled to the gate array circuit GAB.

The shift register SR sends latch signals sequentially to an adjacent shift register. When the shift register SR latches a latch signal, the latching circuits LT1 to LT8 latch the display data from the 96 signal lines. The multiplexer MX selects the latching circuits LT1 to LT8 one at a time, and outputs eight sets of display data in a time division manner. The D/A conversion circuit DA performs D/A conversion on the time-division display data, and the amplifier circuit AP buffers or amplifies and subsequently outputs the D/A conversion voltage to the image signal output terminal.

In the above example, 96 bits of display data need to be latched to one output, and thus 96 signal lines are required. A vertical width of this signal line group WG is denoted as LHW. For example, given a wiring interval of 1 μm, the LHW is approximately 100 μm. Given that the signal line group WG is wired in the direction D2, 100 μm is required as a lateral width BPT of the circuit block corresponding to one output. However, to decrease the lateral width LSW of the display driver IC, the lateral width BPT of the circuit block corresponding to one output needs to be decreased to the extent possible.

Thus, to couple the gate array circuit GAB to the signal line group WG by wiring the signal line group WG in the direction D1, the wiring regions WA1 and WA2 illustrated in FIG. 1 are required. The lateral widths HW of the wiring regions WA1 and WA2 increase as the number of signal lines of the signal line group WG increases, increasing the lateral width LSW of the display driver IC.

For example, when mounting to a flexible substrate or the like is considered, the length LSW of the long side of the display driver IC is preferably about the same as the length of the long side of the electro-optical panel. Thus, when a high-definition electro-optical panel such as a 4K panel is driven, two flexible substrates are stacked and coupled to the electro-optical panel, and one display driver IC is mounted on each of the flexible substrates. When, for example, an attempt is made to consolidate the display driver ICs to one display driver IC, the wiring layout regions described above become problematic, making it difficult to make the length LSW of the long side of the display driver IC and the length of the long side of the electro-optical panel about the same.

Alternatively, in recent years, advances have been made in the development of higher frame rates and higher definition. When the frame rate is doubled, the transfer rate from the gate array circuit GAB to the line latching circuit LTB is doubled. However, when the signal delay is not in time, the number of signal lines needs to be doubled to decrease the transfer rate. Or, when the electro-optical panel is given higher definition, either the multiplex count or the transfer rate needs to be increased. When the multiplex count is increased, the number of signal lines increases by that amount. When the transfer rate is increased, the number of signal lines increases in the same way as the frame rate. When the definition is made higher, the number of outputs increases. This increase results in an increase in the lateral width of the analog circuit ANB and, hence, in the lateral widths HW of the wiring regions WA1 and WA2, making it difficult to align the lateral width LSW of the display driver IC with the lateral width of the electro-optical panel.

Figure 3:
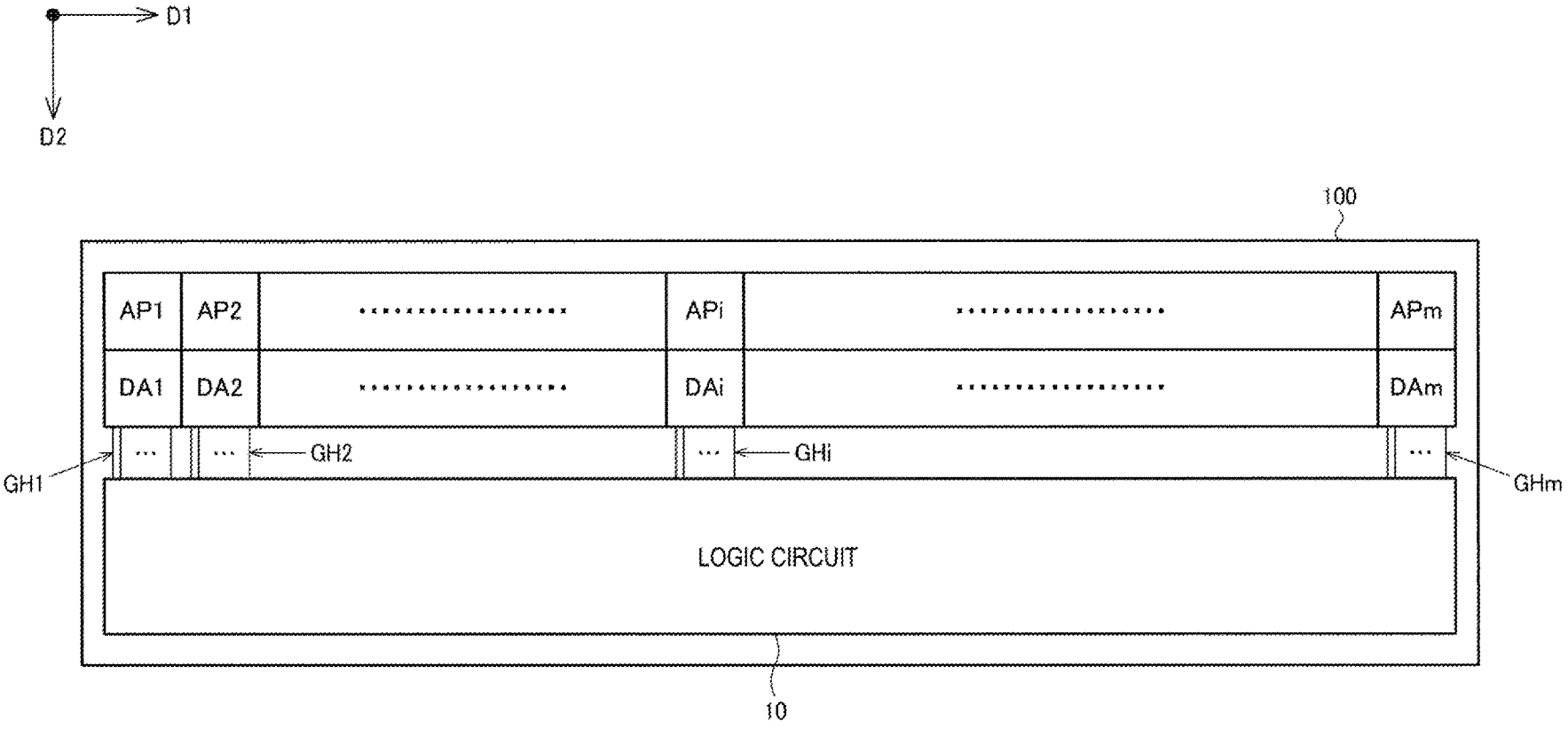
FIG. 3 is an example of a layout configuration of the display driver in the exemplary embodiment.
Figure 4:
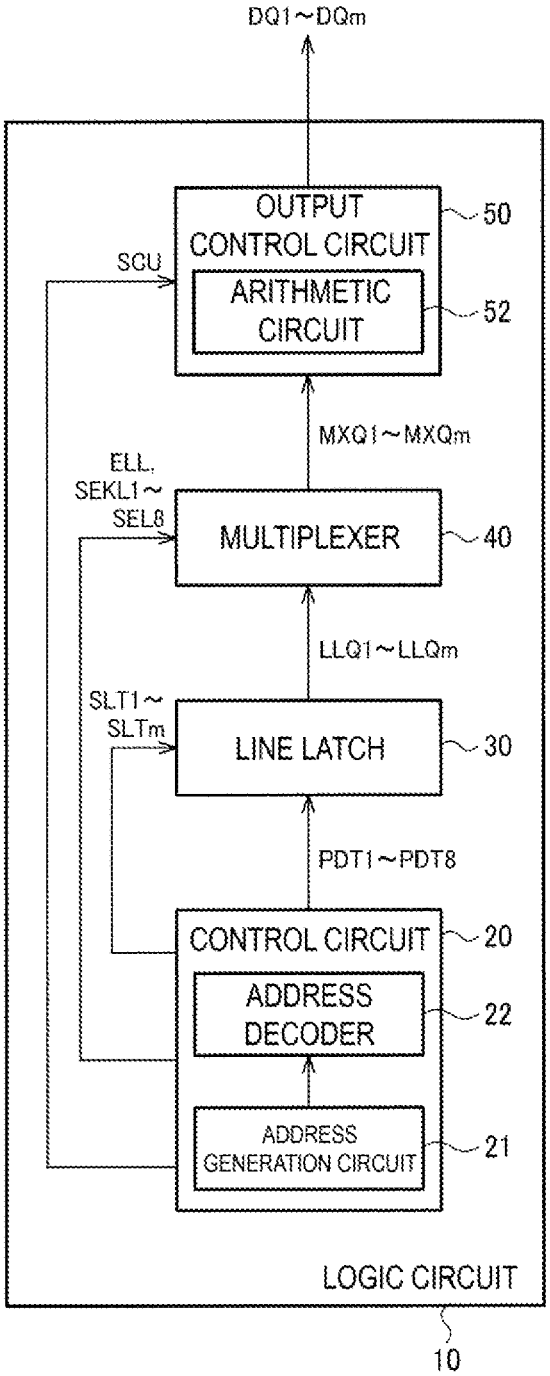
FIG. 4 is a functional block diagram of a logic circuit in the exemplary embodiment.

FIG. 3 is an example of a layout configuration of a display driver 100 in the exemplary embodiment. Further, FIG. 4 is a functional block diagram of a logic circuit 10 in the exemplary embodiment.

FIG. 3 illustrates the layout arrangement when the semiconductor chip is viewed in a plan view from the thickness direction. In FIG. 3, the solid line rectangles indicate layout regions of circuits. Each layout region is a region where the circuit elements constituting the circuit are arranged. Examples of circuit elements include transistors, resistors, capacitors, and the like. A region where a diffusion region, polysilicon, metal wiring, contacts, and the like, constituting these, are arranged is the layout region.

As illustrated in FIG. 3, the display driver 100 includes amplifier circuits AP1 to APm (first to m-th amplifier circuits (m being an integer of 2 or greater)), D/A conversion circuits DA1 to DAm (first to m-th D/A conversion circuits), the logic circuit 10, and signal line groups GH1 to GHm (first to m-th signal line groups).

The amplifier circuits AP1 to APm drive the electro-optical panel. The amplifier circuits AP1 to APm are disposed in the direction D1 (first direction). That is, an amplifier circuit APs+1 is disposed adjacent to an amplifier circuit APs in the direction D1 from the amplifier circuit APs. Here, "s" represents an integer of 1 to m−1, inclusive.

The D/A conversion circuits DA1 to DAm output first to m-th D/A conversion voltages to the amplifier circuits AP1 to APm. The D/A conversion circuits DA1 to DAm are disposed in the direction D1, on the direction D2 side of the amplifier circuits AP1 to APm. That is, the D/A conversion circuit DAi (i-th D/A conversion circuit) is disposed on the direction D2 side of the amplifier circuit APi (i-th amplifier circuit), and the D/A conversion circuit DAi outputs the i-th D/A conversion voltage to the amplifier circuit APi. The amplifier circuit APi amplifies or buffers the i-th D/A conversion voltage to output an image signal. Note that the direction D1 is the direction along the long side of the display driver 100, and the direction D2 is the direction along the short side of the display driver 100, and the direction D2 is orthogonal to the direction D1.

The signal line groups GH1 to GHm couple the D/A conversion circuits DA1 to DAm to the logic circuit 10. That is, the signal line group GHi (i-th signal line group (i being an integer from 1 to m, inclusive)) is provided in the second direction of the D/A conversion circuit DAi, and couples the D/A conversion circuit DAi to the logic circuit 10.

The logic circuit 10 is disposed on the direction D2 side of the D/A conversion circuits DA1 to DAm, and first to n-th display data (n and k being integers greater than or equal to 2) are output to the D/A conversion circuit DAi via the signal line group GHi in a time division manner. The first to n-th display data are each k bits of data. n is the multiplex count of demultiplexing driving. When t is an integer of $2 \leq t \leq k$, the signal line group GHi includes at least t signal lines. t is determined by the number of time divisions and when, for example, the number of divisions is n, t=k. Note that, in the following, an explanation is given using n=8 and k=12 as an example.

According to the exemplary embodiment, the first to eighth display data are output to the D/A conversion circuit DAi from the logic circuit 10 via the signal line group GHi in a time division manner. While the display data of one pixel is 12 bits and thus the first to eighth display data are 96 bits, the number of signal lines of the signal line group GHi can be made less than 96 by outputting this data in a time division manner. For example, when the logic circuit 10 outputs 12 bits at a time in a time division manner, the signal line group GHi may include 12 signal lines. Accordingly, the lateral width of the wiring region of the signal line group GHi can be made narrower than the lateral widths of the D/A conversion circuit DAi and the amplifier circuit APi, allowing the signal line group GHi to be disposed between the D/A conversion circuit DAi and the logic circuit 10. That is, the wiring regions WA1 and WA2 such as in FIG. 1 no longer need to be provided, and the lateral width of the display driver 100 can be shortened.

Further, in the exemplary embodiment, the signal lines of the signal line group GHi may be wired in the direction D2. That is, one end of the signal line is coupled to the D/A conversion circuit DAi, the signal line is extended from the D/A conversion circuit DAi in the direction D2, and the other end of the signal line is coupled to the logic circuit 10. The signal line group GHi includes a plurality of the signal lines in the direction D2, and the plurality of signal lines are disposed side-by-side in the direction D1.

With each of the signal lines of the signal line group GHi wired in the direction D2 in this way, the wiring regions WA1 and WA2 such as in FIG. 1 no longer need to be provided, and the lateral width of the display driver 100 can be shortened.

As illustrated in FIG. 4, the logic circuit 10 includes a control circuit 20, a latching circuit 30, a multiplexer 40, and an output control circuit 50. Note that the output control circuit 50 may be omitted. Here, FIG. 4 illustrates a functional block diagram, and each of the circuits is not necessarily separated in the layout.

Figure 5:
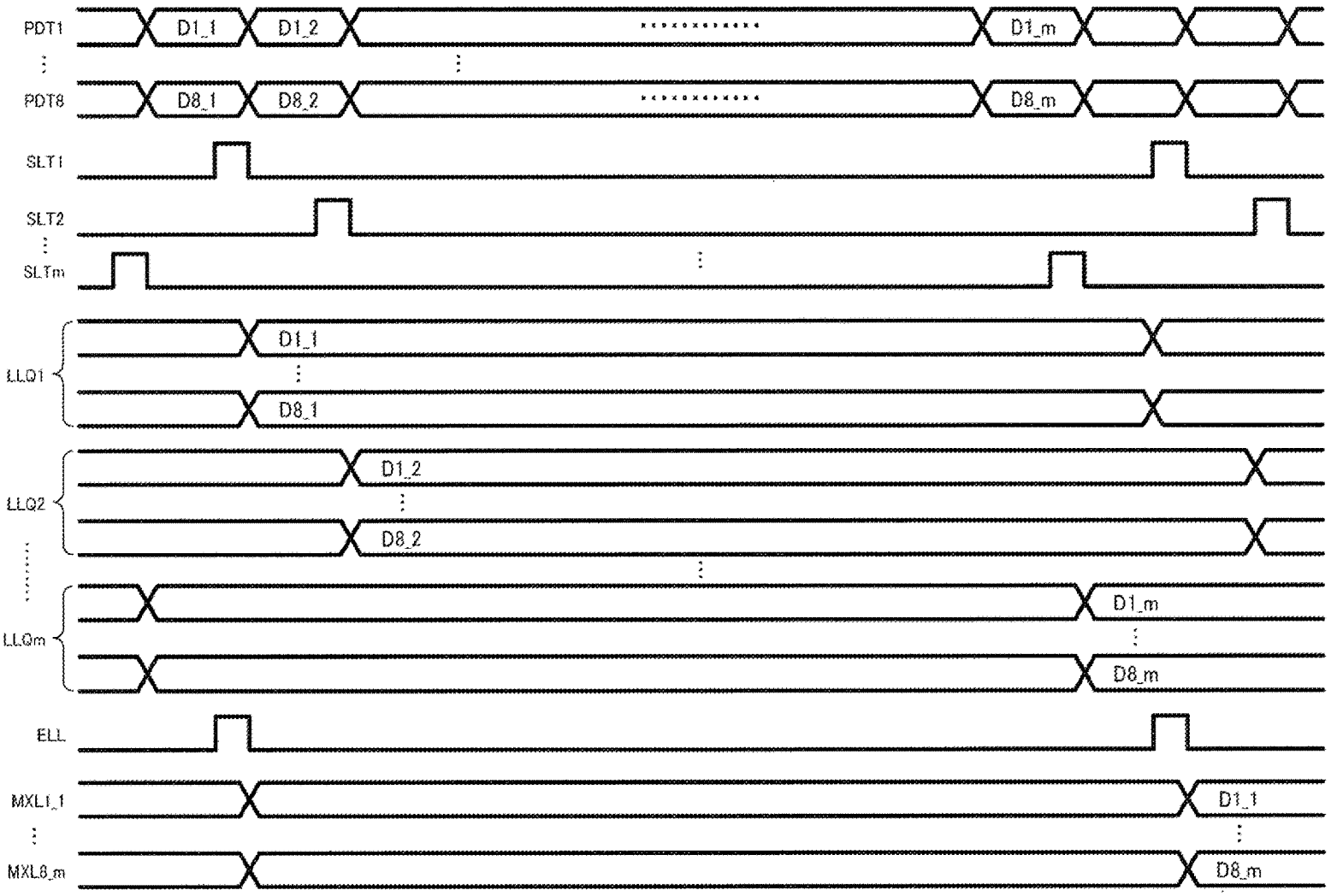
FIG. 5 is a timing chart for explaining an operation of the logic circuit.
Figure 6:
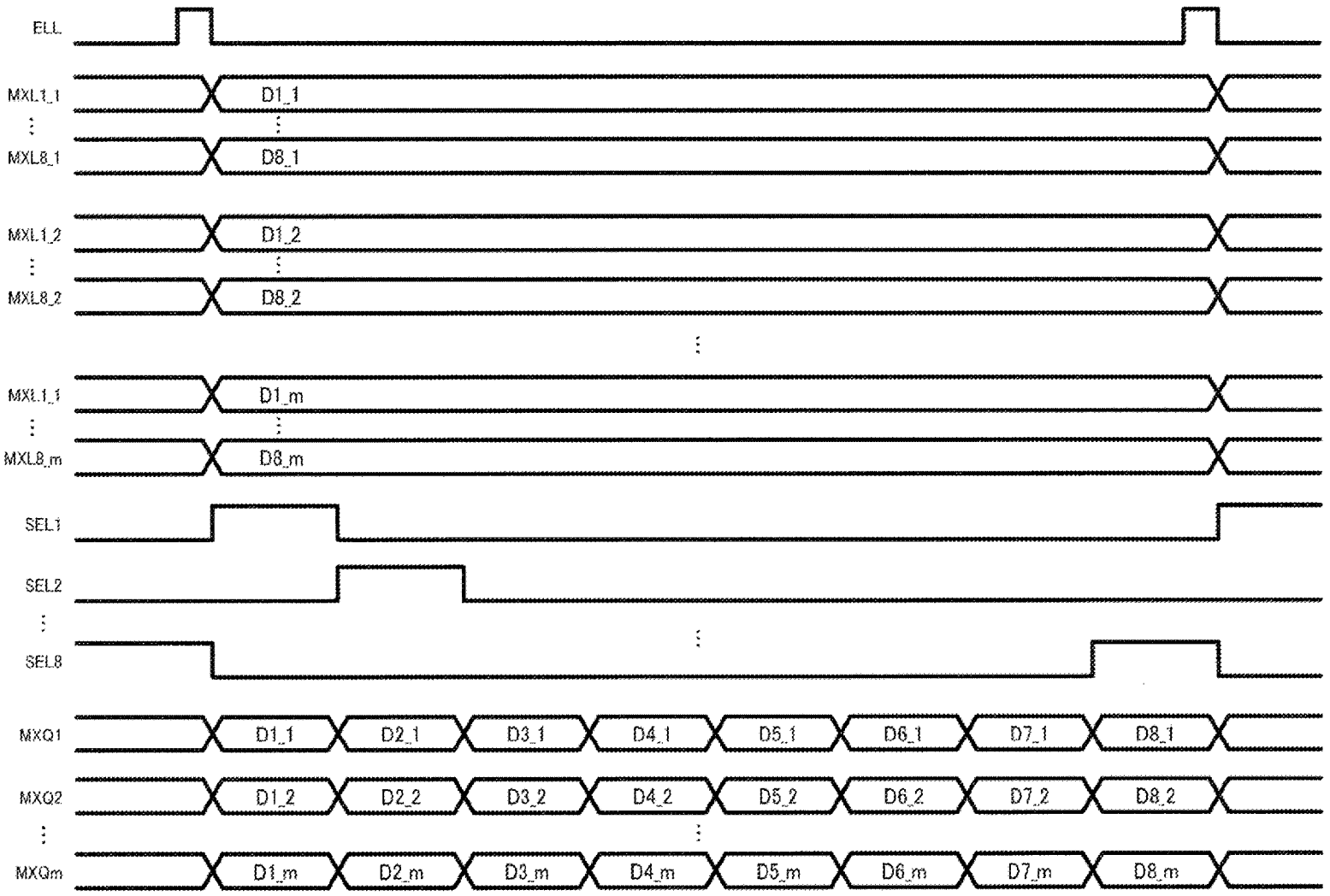
FIG. 6 is a timing chart for explaining the operation of the logic circuit.

FIG. 5 and FIG. 6 are timing charts for explaining an operation of the logic circuit 10. As illustrated in FIG. 5, the control circuit 20 outputs display data PDT1 to PDT8 (first to eighth data). For example, as the display data PDT1, display data D1_1, D1_2, . . . , D1_*m* are output in a time division manner in one horizontal scanning period. Each set of display data D1_1, D1_2, . . . , D1_*m* is the display data of one pixel, and is 12-bit display data.

Further, the control circuit 20 outputs latch signals SLT1 to SLTm. In the latch signals SLT1 to SLTm, a pulse signal sequentially occurs in one horizontal scanning period. At a falling edge of the latch signal SLT1, the latching circuit 30 latches the display data D1_1 to D8_1 as retained data LLQ1. The display data D1_1 to D8_1 are 8 pixels of display data driven in a time division manner in demultiplexing driving. Similarly, at a falling edge of each of the latch signals SLT2, . . . , SLTm, the latching circuit 30 latches the display data D1_2 to D8_2, . . . , D1_*m* to D8_*m* as retained data LLQ2, . . . , LLQm.

As illustrated in FIG. 4, the control circuit 20 includes an address generation circuit 21 and an address decoder 22. The latching circuit 30 includes first to m-th latch groups and the address generation circuit 21 generates an address specifying the latch groups to which the display data PDT1 to PDT8 are to be latched. The address decoder 22 decodes the address, and generates the latch signals SLT1 to SLTm on the basis of the decoding results. That is, a pulse signal is generated in the latch signal in accordance with the latch group specified by the address. Thus, the retained data LLQ1 to LLQm are latched to the first to the m-th latch groups.

The control circuit 20 outputs a latch enable signal ELL to the multiplexer 40. The multiplexer 40 includes a latching circuit, and the retained data LLQ2, . . . , LLQm are latched at the falling edge of the latch enable signal ELL. That is, the display data D1_1 to D8_1, D1_2 to D8_2, . . . , D1_*m* to D8_*m* are latched. The latched retained data are denoted as MXL1_1 to MXL8_1, MXL1_2 to MXL8_2, . . . , MXL1_*m* to MXL8_*m*.

As illustrated in FIG. 6, the control circuit 20 outputs selection signals SEL1 to SEL8 to the multiplexer 40. The selection signals SEL1 to SEL8 are sequentially made active in the horizontal scanning period. In FIG. 6, the high level is active. Note that when rotation is performed in demultiplexing driving, the sequence in which the selection signals SEL1 to SEL8 become active is determined by the rotation process. The multiplexer 40 selects MXL1_1 to MXL1_*m* in the period during which the selection signal SEL1 is active. Thus, the display data D1_1 to D1_*m* are output as output data MXQ1 to MXQm. Similarly, the multiplexer 40 selects MXL2_1 to MXL2_*m*, . . . , MXL8_1 to MXL8_*m* in the period during which the selection signals SEL2, . . . , SEL8 are active. Thus, the display data D2_1 to D2_*m*, . . . , D8_1 to D8_*m* are output as the output data MXQ1 to MXQm.

The output control circuit 50 performs, for example, arithmetic processing and a time-division process on the output data MXQ1 to MXQm of the multiplexer 40, and outputs the results as display data DQ1 to DQm. That is, arithmetic processing and a time-division process, for example, are performed on the output data MXQi, and the processed data is output as the display data DQi to the D/A conversion circuit DAi via the signal line group GHi. When the output control circuit 50 performs arithmetic processing, the output control circuit 50 can include an arithmetic circuit 52. As described later, the arithmetic circuit 52 performs, for example, a gray coding process, an overdrive arithmetic, or the like. The control circuit 20 outputs a control signal SCU to the output control circuit 50. The control signal SCU is a signal for controlling the time-division timing, for example.

Note that the output control circuit 50 may be omitted, and the output data MXQ1 to MXQm of the multiplexer 40 may be output as display data DQ1 to DQm. Further, the arithmetic circuit 52 of the output control circuit 50 may be omitted, and an arithmetic circuit equivalent thereto may be provided on the D/A conversion circuit side.

According to the exemplary embodiment above, the logic circuit 10 latches the display data, and outputs the latched display data in a time division manner. Taking the display data DQi as an example, the control circuit 20 outputs PDT1 to PDT8=D1_*i* to D8_*i*, and the latching circuit 30 latches LLQi=D1_*i* to D8_*i*. The multiplexer 40 selects D1_*i* to D8_*i* in a time division manner, and outputs the time-division data as the output data MXQi. The output control circuit 50 processes the output data MXQi, and outputs the display data DQi.

According to this exemplary embodiment, the data output by the logic circuit 10 via the signal line group GHi is the display data DQi. The display data DQi is data obtained by selecting D1_*i* to D8_*i* in a time division manner, and is thus 12 bits. Or, when the output control circuit 50 is further subjected to time division, the number of bits is less than 12 bits. As a result, the signal line group GHi is a signal line group including 12 or less signal lines, and the width of the wiring region can be set to the lateral width of the D/A conversion circuit DAi or less.

Further, according to this exemplary embodiment, the logic circuit 10 is a gate array circuit automatically arranged and wired, or a standard cell array circuit. Specifically, the logic circuit 10 includes logic elements and signal lines between the logic elements, and the function of the logic circuit 10 is realized by the logic elements and the signal lines. The logic elements are, for example, logic arithmetic elements such as an AND element or an OR element, or storage elements such as a flip-flop circuit. The gate array circuit automatically arranged and wired is an array circuit in which a logic gate is automatically arranged, and signal lines are automatically wired. Further, in the standard cell array circuit, the logic elements are standardized cells. The standard cell array circuit is an array circuit in which signal lines are automatically wired for arranged logic elements.

According to this exemplary embodiment, the latching circuit 30 and the multiplexer 40 in FIG. 4 equivalent to the line latching circuit LTB in FIG. 1 are realized by a gate array circuit or a standard cell array circuit. In the related art, when a line latching circuit is included in a gate array circuit, the transistor size of the logic elements increases taking into consideration a signal delay, resulting in the problem of an increased chip surface area. As a result, the layout surface area is reduced by arranging the layout of the line latching circuit separately from that of the gate array circuit. However, with advancements in process technology, it is possible to suppress the chip surface area even when the line latching circuit is included in the gate array circuit. In this exemplary embodiment, the latching circuit 30 and the multiplexer 40 are included in the gate array circuit or the standard cell array circuit, making it possible to wire the signal line group GHi between the logic circuit 10 and the D/A conversion circuit DAi.

2. Examples of Detailed Configuration

Figure 7:
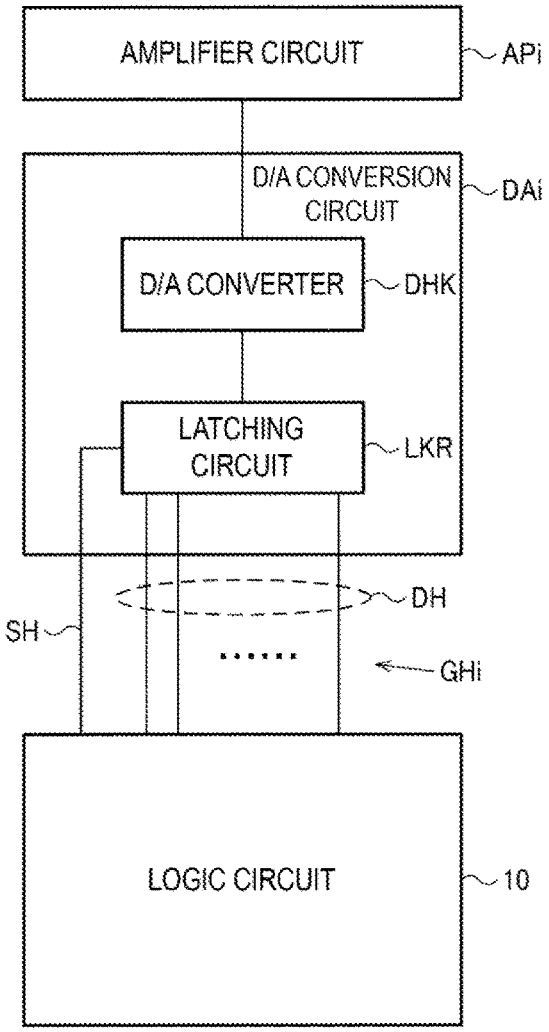
FIG. 7 is a functional block diagram of a first example of a detailed configuration of a D/A conversion circuit and a signal line group.

FIG. 7 is a functional block diagram of a first example of a detailed configuration of the D/A conversion circuit DAi and the signal line group GHi. The D/A conversion circuit DAi includes a D/A converter DHK and a latching circuit LKR. Further, the signal line group GHi includes the signal line group DH and the signal line SH.

The signal line group DH includes signal lines that transmit the display data DQi. Specifically, 1 bit of the display data DQi is transmitted by one signal line, and thus the signal line group DH includes the same number of signal lines as the number of bits of the display data DQi. The signal line SH transmits the latch signal of the latching circuit LKR as a control signal. For example, when the logic circuit 10 outputs MXQi of FIG. 6 as DQi, the logic circuit 10 outputs D1_*i*, D2_*i*, . . . , D8_*i* sequentially via the signal line group DH, and outputs the latch signal via the signal line SH. The latching circuit LKR latches D1_*i* on the basis of the latch signal, and outputs the latched D1_*i* to the D/A converter DHK. Next, similarly, D2_*i*, . . . , D8_*i* are latched sequentially, and the latched D2_*i*, . . . , D8_*i* are output sequentially to the D/A converter DHK. Note that the signal line group GHi may further include a signal line that transmits a control signal other than the control signal described above. For example, a signal line that transits a control signal of the amplifier circuit APi may be further included.

According to this exemplary embodiment, the signal line group GHi can include the control signal of the D/A conversion circuit DAi. That is, the display data DQi and the control signal of the D/A conversion circuit DAi can be transmitted via the signal line group GHi disposed between the D/A conversion circuit DAi and the logic circuit 10.

Figure 8:
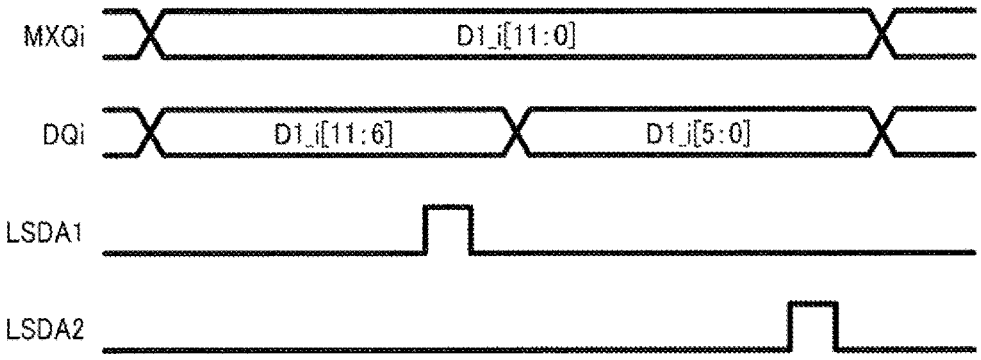
FIG. 8 is a first timing chart for explaining an operation of the logic circuit and the D/A conversion circuit.

FIG. 8 is a first timing chart for explaining an operation of the logic circuit 10 and the D/A conversion circuit DAi. FIG. 8 explains an example in which the multiplexer 40 outputs 12-bit display data D1_*i* [11:0] as the output data MXQi.

The output control circuit 50 outputs high order side bit data D1_*i* [11:6] and low order side bit data D1_*i* [5:0] of the display data D1_*i* [11:0] in a time division manner. DQi is 6-bit data, and the signal line group DH in FIG. 7 includes six signal lines. The output control circuit 50 outputs the latch signals LSDA1 and LSDA2 to the latching circuit LKR of the D/A conversion circuit DAi. The latching circuit LKR latches the high order side bit data D1_*i* [11:6] on the basis of the latch signal LSDA1, and latches the low order side bit data D1_*i* [5:0] on the basis of the latch signal LSDA2. As a result, the latching circuit LKR retains the display data D1_*i* [11:0]. The signal line SH in FIG. 7 transmits the latch signal LSDA1, for example, and the signal line group GHi further includes the signal line that transmits the latch signal LSDA2. Thereafter, similarly, the output control circuit 50 outputs the high order side bit data and the low order side bit data of the display data D2_*i*, . . . , D8_*i* in a time division manner, and the latching circuit LKR latches the high order side bit data and the low order side bit data of the display data D2_*i*, . . . , D8_*i*.

According to this exemplary embodiment, the logic circuit 10 divides the display data D1_*i* to D8_*i* into high order side bit data and low order side bit data, respectively, and outputs the high order side bit data and the low order side bit data in a time division manner. Here, the high order side bit data are predetermined bit data that include MSB of the display data, and the low order side bit data are predetermined bit data that include LSB of the display data.

Accordingly, the number of signal lines in the signal line group DH that transmits the display data DQi can be reduced to 12/2=6, and thus the lateral width of the wiring region of the signal line group GHi can be further narrowed. For example, when the number of outputs of the image signal is increased and an attempt is made to maintain the lateral width of the display driver 100, the lateral width per D/A conversion circuit is narrowed. According to this exemplary embodiment, the number of signal lines of the signal line group GHi is reduced, making it possible to support a D/A conversion circuit having a narrow lateral width as well.

Figure 9:
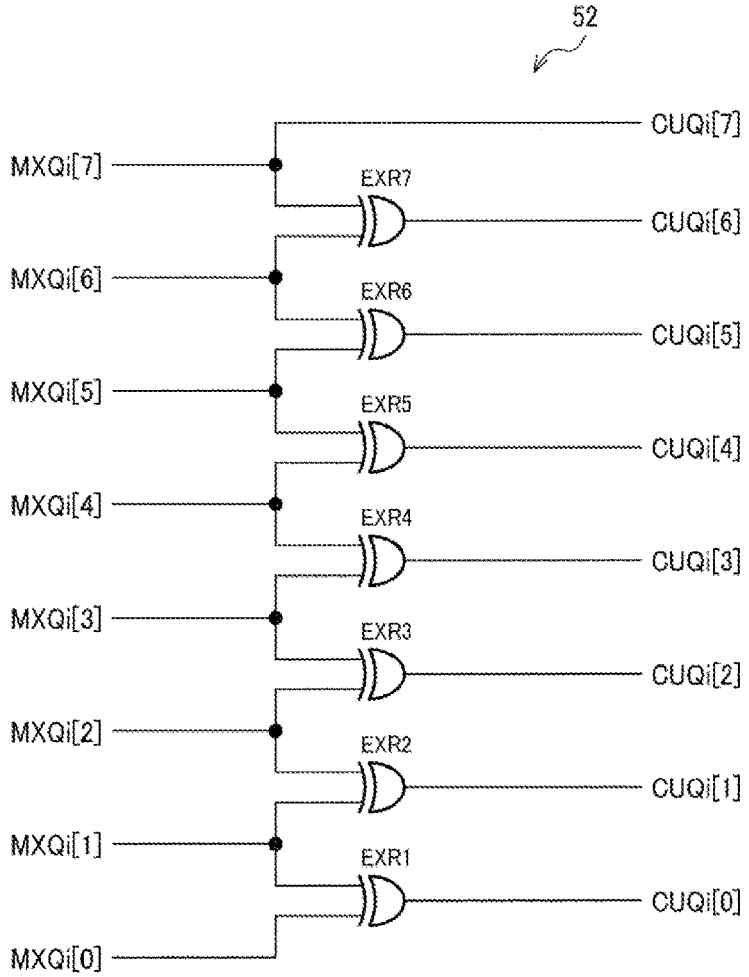
FIG. 9 is a first example of a detailed configuration of an arithmetic circuit.

FIG. 9 is a first example of a detailed configuration of the arithmetic circuit 52. Note that, in FIG. 9, the number of bits of the display data is 8. That is, k=8.

The arithmetic circuit 52 in FIG. 9 performs a gray coding process. Specifically, the arithmetic circuit 52 includes exclusive logical sum circuits EXR1 to EXR7. The output data of the multiplexer 40 is MXQi [7:0], and the output data of the arithmetic circuit 52 is CUQi [7:0]. The exclusive logical sum circuit EXRa finds the exclusive logical sum of MXQi [a−1] and MXQi [a], and outputs the result as CUQi [a−1]. Here, "a" represents an integer within the range of 1 to 7, inclusive. Note that CUQi [7]=MXQi [7]. The output control circuit 50 outputs DQi [7:0]=CUQi [7:0], for example. Or, CUQi [7:0] is divided into high order side bit data and low order side bit data as in FIG. 8, and output in a time division manner.

Figure 10:
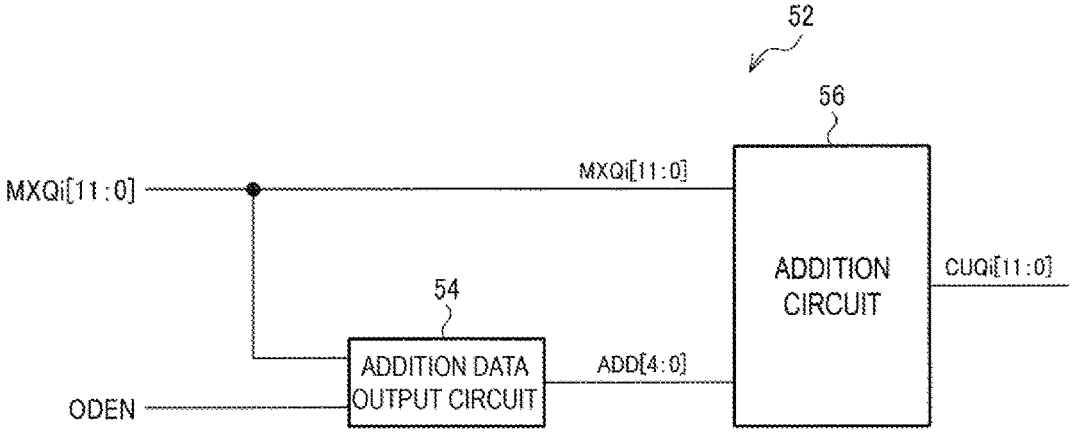
FIG. 10 is a second example of a detailed configuration of the arithmetic circuit.
Figure 11:
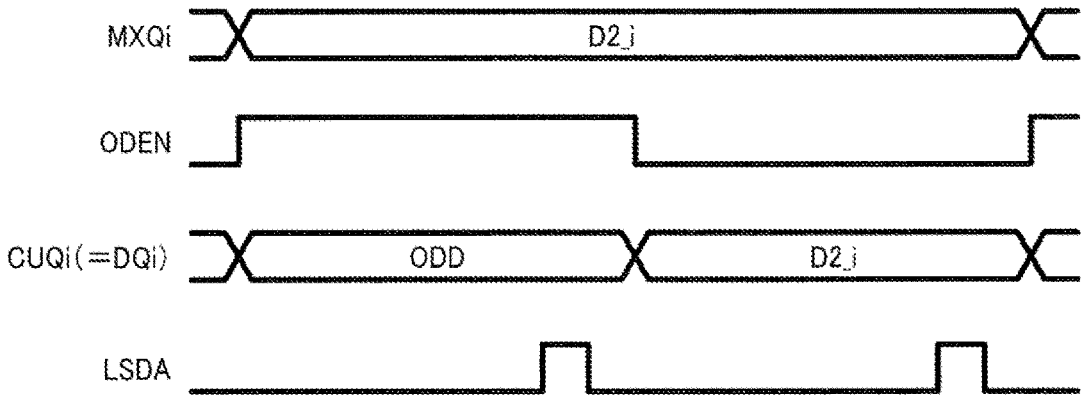
FIG. 11 is a second timing chart for explaining the operation of the logic circuit and the D/A conversion circuit.

FIG. 10 is a second example of a detailed configuration of the arithmetic circuit 52. Further, FIG. 11 is a second timing chart for explaining the operation of the logic circuit 10 and the D/A conversion circuit DAi. Note that, here, the number of bits of the display data is 12. That is, k=12.

As illustrated in FIG. 10, the arithmetic circuit 52 includes an addition data output circuit 54, and an addition circuit 56. The addition data output circuit 54 outputs addition data ADD [4:0] on the basis of the output data MXQi [11:0] of the multiplexer 40. The control circuit 20 outputs an enable signal ODEN of an overdrive arithmetic. This enable signal ODEN corresponds to the control signal SCU in FIG. 4. The addition data output circuit 54 outputs the addition data ADD [4:0], which is not zero, when ODEN is "Enable", and the addition data ADD [4:0]=0 when ODEN is "Disable". Note that, while the addition data here is 5 bits, the number of bits of the addition data is not limited thereto. The addition circuit 56 adds MXQi [11:0] and ADD [4:0], and outputs the result as output data CUQi [11:0].

FIG. 11 illustrates a timing chart when MXQi=D2_*i*. In FIG. 11, [11:0] and the like expressing the bit configuration of the data are omitted. Further, in FIG. 11, the high level of the enable signal ODEN corresponds to "Enable". The addition data output circuit 54 retains D1_*i* when D1_*i* before D2_*i* is input, and finds D2-*i*−D1_*i* when D2_*i* is input. During the high level period of the enable signal ODEN, the addition data output circuit 54 outputs the addition data of ADD>0 when D2_*i*−D1_*i*>0, and outputs the addition data of ADD<0 when D2_*i*−D1_*i*<0. The addition circuit 56 outputs CUQi=D2_*i*+ADD=ODD. ODD is called overdrive display data. During the low level period of the enable signal ODEN, the addition circuit 56 outputs CUQi=D2_*i*. The output control circuit 50 outputs the output data CUQi of the addition circuit 56 as the display data DQi.

The output control circuit 50 outputs the latch signal LSDA to the latching circuit LKR of the D/A conversion circuit DAi, and the latching circuit LKR sequentially latches ODD, D2_*i* on the basis of the latch signal LSDA. The latch signal LSDA is transmitted by the signal line SH in FIG. 7. The D/A conversion circuit DAi sequentially performs D/A conversion on ODD, D2_*i*, and outputs the result. As a result, first the amplifier circuit APi drives the data lines and pixels using image signals corresponding to the overdrive display data ODD, and then drives the data lines and pixels using the image signals corresponding to the normal display data D2_*i*. The image signals corresponding to the overdrive display data ODD accelerate data line and pixel voltage changes, making high-speed pixel writing possible.

According to this exemplary embodiment, the logic circuit 10 performs an overdrive arithmetic based on the display data D2_*i*, and outputs the overdrive display data ODD obtained by the overdrive arithmetic, and the display data D2_*i* in a time division manner. Note that, while the explanation here uses the display data D2_*i* (second display data) as an example, in a broad sense the display data may be display data Dj_i (j-th display data, where j is an integer from 1 to n, inclusive).

The overdrive display data ODD and the display data D2_*i* are each 12 bits, and thus the number of signal lines in the signal line group DH in FIG. 7 may be 12 by outputting these in a time division manner. That is, overdrive can be realized without increasing the number of signal lines in the signal line group GHi.

Figure 12:
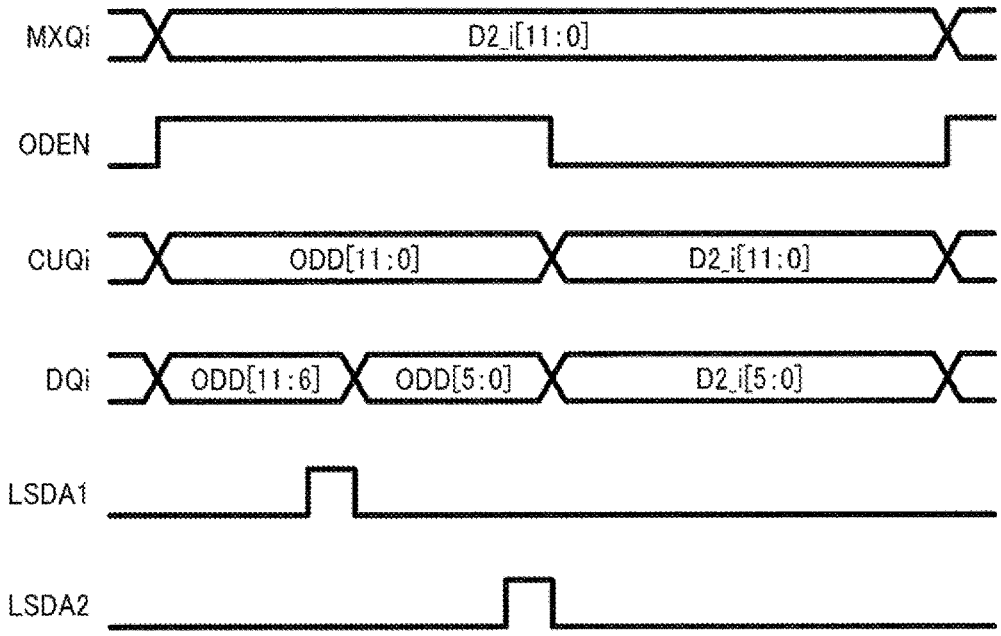
FIG. 12 is a third timing chart for explaining the operation of the logic circuit and the D/A conversion circuit.

FIG. 12 is a third timing chart for explaining the operation of the logic circuit 10 and the D/A conversion circuit DAi. In FIG. 12, the overdrive display data ODD is further output in a time division manner. Note that descriptions of content that is the same as in FIG. 11 will be omitted.

As illustrated in FIG. 12, during the high level period of the enable signal ODEN, the output control circuit 50 outputs high order side bit data ODD [11:6] and low order side bit data ODD [5:0] of overdrive display data ODD [11:0] in a time division manner. Further, during the low level period of the enable signal ODEN, the output control circuit 50 outputs the low order side bit data ODD [5:0] of the display data D2_*i* [11:0]. The output control circuit 50 outputs the latch signals LSDA1 and LSDA2 to the latching circuit LKR of the D/A conversion circuit DAi. The latching circuit LKR latches the high order side bit data ODD [11:6] on the basis of the latch signal LSDA1, and latches the low order side bit data ODD [5:0] and D2_*i* [5:0] on the basis of the latch signal LSDA2. When the latching circuit LKR latches D2_*i* [5:0], only the low order side bit data is updated, and thus the high order side bit data remains as ODD [11:6].

According to this exemplary embodiment, the logic circuit 10 divides the overdrive display data ODD [11:0] and the display data D2_*i* into high order side bit data and low order side bit data, respectively, and outputs the high order side bit data ODD [11:6] and the low order side bit data ODD [5:0] of the overdrive display data as well as the low order side bit data D2_*i* [5:0] of the display data in a time division manner.

In the example in FIG. 10, the addition data ADD [4:0] is 5 bits, and thus the high order side bit data of CUQi [11:0] is CUQi [11:6]=MXQi [11:6]. That is, in FIG. 12, ODD [11:6]=D2_*i* [11:6]. In such a case, there is no need to send the high order side bit data D2_*i* [11:6] to the D/A conversion circuit DAi again. In this exemplary embodiment, only the low order side bit data ODD [5:0] and D2_*i* [5:0] in which the data changes are re-sent. As a result, the number of times that the latching circuit LKR performs a latching operation can be reduced. For example, when the 4K panel performs demultiplexing driving with a multiplex count of 8, the number of outputs of the display driver 100 becomes 480 or greater. The number of latching circuits LKR provided is the same as the number of outputs and thus, taking into consideration the effects of an increased frame rate, the number of latching operations per second increases extensively. Thus, with a reduction in the number of latching operations, a reduction in power consumption can be expected.

Figure 13:
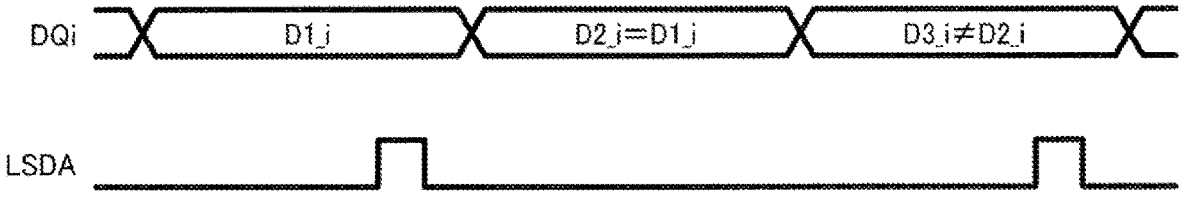
FIG. 13 is a fourth timing chart for explaining the operation of the logic circuit and the D/A conversion circuit.

FIG. 13 is a fourth timing chart for explaining the operation of the logic circuit 10 and the D/A conversion circuit DAi.

As illustrated in FIG. 13, the output control circuit 50 sequentially outputs D1_*i*, D2_*i* and D3_*i* as the display data DQi. The output control circuit 50 outputs the latch signal LSDA to the latching circuit LKR of the D/A conversion circuit DAi, and the latching circuit LKR latches the display data DQi on the basis of the latch signal LSDA. When D2_*i*=D1_*i* and D3_*i*≠D2_*i*, the output control circuit 50 generates a pulse signal in the latch signal LSDA during the output period of D1_*i* and D3_*i*, but does not generate a pulse signal in the latch signal LSDA in the output period D2_*i*. That is, the latching circuit LKR does not perform the operation of latching D2_*i*.

According to this exemplary embodiment, the logic circuit 10 outputs the display data D1_*i* and the latch signal LSDA that latches the display data D1_*i* and, when the display data D2_*i* following the display data D1_*i* is the same as the display data D1_*i*, does not output the latch signal LSDA that latches the display data D2_*i*.

Accordingly, when the display data output to the D/A conversion circuit DAi by the logic circuit 10 does not change from the previous display data, the latch signal LSDA is not output, and thus the latching circuit LKR of the D/A conversion circuit DAi does not perform the latching operation. As a result, the number of latching operations is reduced, and thus a reduction in power consumption can be expected.

Note that, while the explanation in FIG. 13 uses the display data D1_*i* and D2_*i* as an example, in a broad sense the display data may be display data Dp_i (p-th display data, where p is an integer from 1 to n, inclusive), and display data Dq_i (q-th display data, where q is an integer from 1 to n, inclusive, and q≠p). For example, when a rotation process is performed, the output sequence of the display data is determined by the rotation process.

Figure 14:
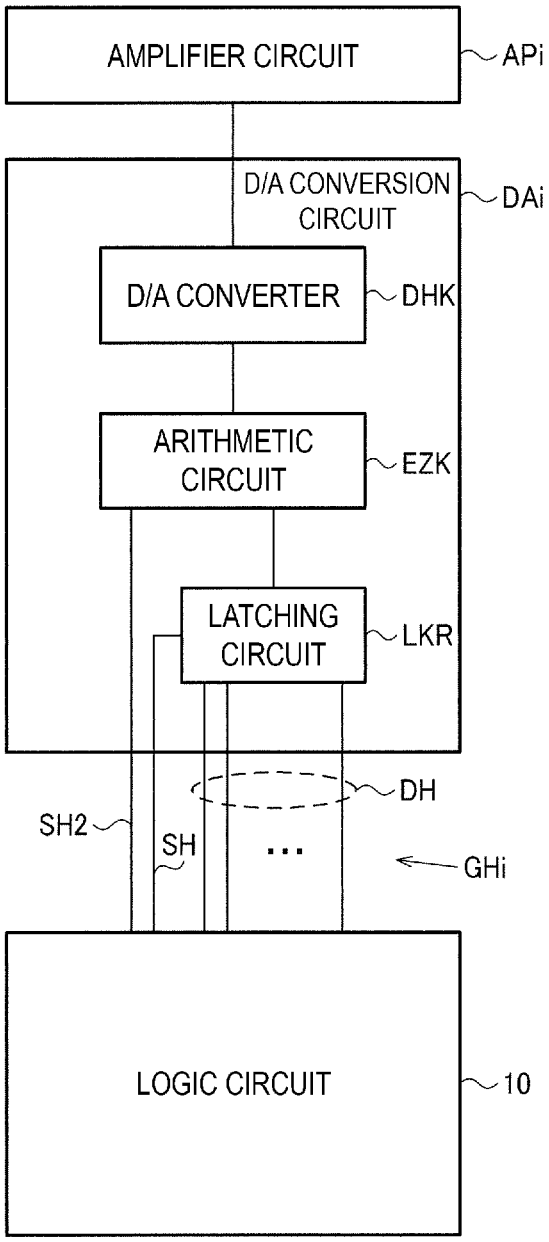
FIG. 14 is a functional block diagram of a second example of a detailed configuration of the D/A conversion circuit and the signal line group.

FIG. 14 is a functional block diagram of a second example of a detailed configuration of the D/A conversion circuit DAi and the signal line group GHi. The D/A conversion circuit DAi includes the D/A converter DHK, an arithmetic circuit EZK, and the latching circuit LKR. Further, the signal line group GHi includes the signal line group DH and the signal lines SH and SH2. Note that the components that are the same as the components described in FIG. 7 are referenced using like numbers, and no descriptions for such components are provided below.

The logic circuit 10 outputs a control signal for controlling the arithmetic processing of the arithmetic circuit EZK to the arithmetic circuit EZK via the signal line SH2. The arithmetic circuit EZK performs arithmetic processing on the retained data of the latching circuit LKR on the basis of the control signal. The D/A converter DHK performs D/A conversion on the output data of the arithmetic circuit EZK.

Specifically, the arithmetic circuit 52 in FIG. 4 is omitted, and the arithmetic circuit EZK having an equivalent configuration is provided to the D/A conversion circuit DAi. For example, the arithmetic circuit EZK performs at least one of a gray coding process and an overdrive arithmetic. In this case, the enable signal ODEN is transmitted by the signal line SH2. Or, the arithmetic circuit 52 in FIG. 4 may perform an overdrive arithmetic, and the arithmetic circuit EZK in FIG. 14 may perform a gray coding process. The arithmetic circuit EZK includes a latching circuit that latches display data after the gray coding process, and the logic circuit 10 outputs the latch signal to the latching circuit via the signal line SH2.

According to this exemplary embodiment, the D/A conversion circuit DAi includes the arithmetic circuit EZK that performs arithmetic processing based on the display data D1-*i* to D8_*i*. The control signal output by the logic circuit 10 to the D/A conversion circuit DAi via the signal line group GHi is a signal that controls the arithmetic circuit EZK.

According to this exemplary embodiment, the signal line group GHi can include the control signal of the arithmetic circuit EZK. That is, the display data D1_*i* to D8_*i* and the control signal of the arithmetic circuit EZK can be transmitted via the signal line group GHi disposed between the D/A conversion circuit DAi and the logic circuit 10.

3. Electro-optical Device and Electronic Apparatus

Figure 15:
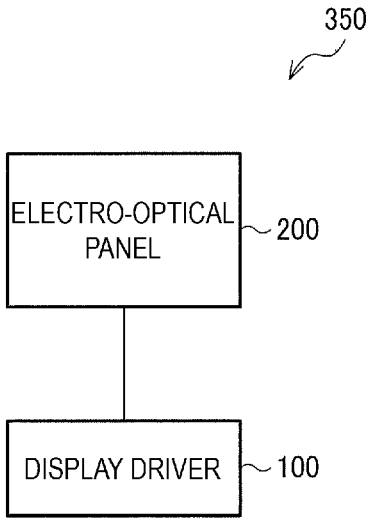
FIG. 15 is an example of a configuration of an electro-optical device.

FIG. 15 illustrates an example of a configuration of an electro-optical device 350 including the display driver 100. The electro-optical device 350 includes the display driver 100 and an electro-optical panel 200.

The electro-optical panel 200 is, for example, an active matrix type liquid crystal display panel. For example, the display driver 100 is mounted on a flexible substrate, the flexible substrate is coupled to the electro-optical panel 200, and the image-signal output terminals of the display driver 100 and the image-signal input terminals of the electro-optical panel 200 are coupled via lines formed on the flexible substrate. Alternatively, the display driver 100 may be mounted on a rigid substrate, the rigid substrate and the electro-optical panel 200 may be coupled via a flexible substrate, and the image-signal output terminals of the display driver 100 and the image-signal input terminals of the electro-optical panel 200 may be coupled via lines formed on the rigid substrate and the flexible substrate.

Figure 16:
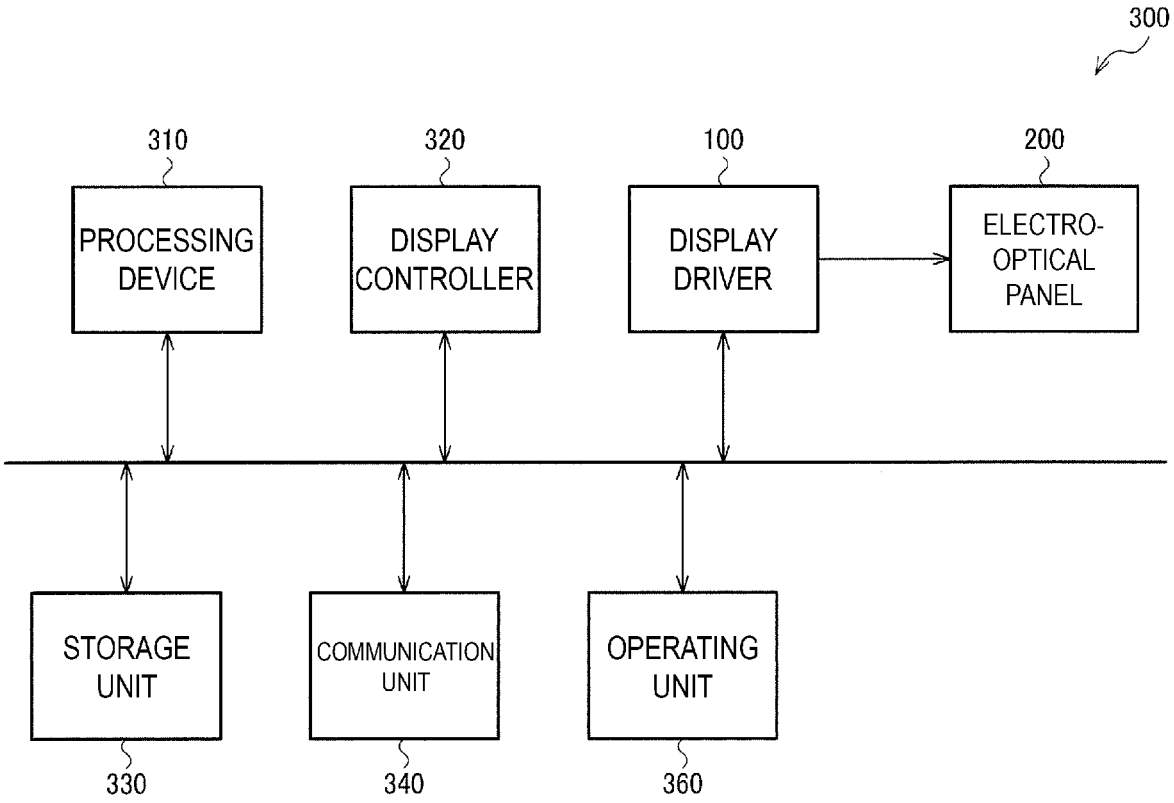
FIG. 16 is an example of a configuration of an electronic apparatus.

FIG. 16 illustrates an example of a configuration of an electronic apparatus 300 including the display driver 100. The electronic apparatus 300 includes a processing device 310, a display controller 320, the display driver 100, the electro-optical panel 200, a storage unit 330, a communication unit 340, and an operating unit 360. The storage unit 330 is also called a storage device or memory. The communication unit 340 is also called a communication circuit or a communication device. The operating unit 360 is also called an operation device. Specific examples of the electronic apparatus 300 may include various electronic apparatuses provided with display devices, such as a projector, a head-mounted display, a mobile information terminal, a vehicle-mounted device, a portable game terminal, and an information processing device. The vehicle-mounted device is, for example, a meter panel, a car navigation system, or the like.

The operating unit 360 is a user interface for various types of operations by a user. For example, the operating unit 360 is a button, a mouse, a keyboard, and/or a touch panel mounted on the electro-optical panel 200. The communication unit 340 is a data interface used for inputting and outputting image data and control data. Examples of the communication unit 340 include a wireless communication interface, such as a wireless LAN interface or a near field communication interface, and a wired communication interface, such as wired LAN interface or a USB interface. The storage unit 330, for example, stores data input from the communication unit 340 or functions as a working memory for the processing device 310. The storage unit 330 is, for example, a memory, such as a RAM or a ROM, a magnetic storage device, such as an HDD, or an optical storage device, such as a CD drive or a DVD drive. The display controller 320 processes image data input from the communication unit 340 or stored in the storage unit 330, and transfers the processed image data to the display driver 100. The display driver 100 displays an image on the electro-optical panel 200 on the basis of the image data transferred from the display controller 320. The processing device 310 carries out control processing for the electronic device 300 and various types of signal processing. The processing device 310 is, for example, a processor, such as a CPU or an MPU, or an ASIC.

For example, in a case where the electronic apparatus 300 is a projector, the electronic apparatus 300 further includes a light source and an optical system. The optical system is, for example, a lens, a prism, a mirror, or the like. In the case where the electro-optical panel 200 is of a transmissive type, the optical device emits light from the light source to the electro-optical panel 200, and the light transmitted through the electro-optical panel 200 is projected on a screen. In the case where the electro-optical panel 200 is of a reflective type, the optical device emits light from the light source to the electro-optical panel 200, and the light reflected at the electro-optical panel 200 is projected on a screen.

Although some exemplary embodiments have been described in detail above, those skilled in the art will understand that many modified examples can be made without substantially departing from the novel matter and effects of the invention. All such modified examples are thus included in the scope of the invention. For example, terms in the descriptions or drawings given even once along with different terms having identical or broader meanings can be replaced with those different terms in all parts of the descriptions or drawings. All combinations of the exemplary embodiments and modified examples are also included within the scope of the invention. Furthermore, the configurations and operations of the display driver, the electro-optical device, and the electronic apparatus are not limited to those described in the exemplary embodiments, and various modifications thereof are possible.

The entire disclosure of Japanese Patent Application No. 2018-050396, filed Mar. 19, 2018 is expressly incorporated by reference herein.

What is claimed is:

1. A display driver comprising:

first to m-th amplifier circuits configured to drive an electro-optical panel, the m being an integer greater than or equal to 2;

first to m-th D/A conversion circuits configured to output first to m-th D/A conversion voltages to the first to m-th amplifier circuits;

a logic circuit; and first to m-th signal line groups configured to couple the first to m-th D/A conversion circuits to the logic circuit, wherein the first to m-th amplifier circuits are disposed in a first direction, the first to m-th D/A conversion circuits are disposed in the first direction on a second direction of the first to m-th amplifier circuits, the second direction being orthogonal to the first direction, and the logic circuit is disposed on the second direction of the first to m-th D/A conversion circuits, and configured to output first to n-th display data with each display data being k bits, in a time division manner to an i-th D/A conversion circuit of the first to m-th D/A conversion circuits via an i-th signal line group of the first to m-th signal line groups, the n and k being integers greater than or equal to 2 and the i being an integer from 1 to m, inclusive.

2. The display driver according to claim 1, wherein the logic circuit is configured to latch the first to n-th display data, and output the latched first to n-th display data in a time division manner.

3. The display driver according to claim 1, wherein the logic circuit is a gate array circuit automatically arranged and wired, or a standard cell array circuit automatically arranged.

4. The display driver according to claim 1, wherein the logic circuit is configured to divide the first to n-th display data into high order side bit data and low order side bit data, and output the high order side bit data and the low order side bit data in a time division manner.

5. The display driver according to claim 1, wherein the logic circuit is configured to perform an overdrive arithmetic based on j-th display data of the first to n-th display data, and output overdrive display data obtained by the overdrive arithmetic, and the j-th display data in a time division manner, the j being an integer from 1 to n, inclusive.

6. The display driver according to claim 5, wherein the logic circuit is configured to divide the overdrive display data and the j-th display data into high order side bit data and low order side bit data, and output the high order side bit data and the low order side bit data of the overdrive display data, and the low order side bit data of the j-th display data in a time division manner.

7. The display driver according to claim 1, wherein the logic circuit is configured to output a control signal of the i-th D/A conversion circuit to the i-th D/A conversion circuit via the i-th signal line group, and the i-th signal line group includes a signal line configured to transmit the first to n-th display data, and a signal line configured to transmit the control signal.

8. The display driver according to claim 7, wherein the i-th D/A conversion circuit includes an arithmetic circuit configured to perform arithmetic processing based on the first to n-th display data, and the control signal is a signal configured to control the arithmetic circuit.

9. The display driver according to claim 7, wherein the i-th D/A conversion circuit includes a latching circuit configured to latch display data from the logic circuit, the control signal is a latch signal of the latching circuit, and the logic circuit is configured to output p-th display data of the first to n-th display data and the latch signal configured to latch the p-th display data, and not to output the latch signal configured to latch q-th display data when the q-th display data following the p-th display data is the same as the p-th display data, the p being an integer from 1 to n, inclusive, and the q being an integer from 1 to n, inclusive, and $q \neq p$.

10. The display driver according to claim 1, wherein each of the signal lines of the i-th signal line group is wired in the second direction.

11. An electro-optical device comprising:

the display driver according to claim 1; and the electro-optical panel.

12. An electronic apparatus comprising:

the display driver according to claim 1.

* * * * *